US005633046A

United States Patent [19]

Petropoulos et al.

[11] Patent Number: 5,633,046

[45] Date of Patent: May 27, 1997

[54] MULTIPLE DIP COATING METHOD

[75] Inventors: Mark C. Petropoulos, Ontario; Geoffrey M. T. Foley, Fairport; Robert W. Hedrick, Spencerport; Richard H. Nealey, Penfield, all of N.Y.

[73] Assignee: Xerox Corporation, Stamford, Conn.

[21] Appl. No.: 447,138

[22] Filed: May 22, 1995

[51] Int. Cl.[6] ..... B05D 7/00

[52] U.S. Cl. ..... 427/430.1; 427/407.1

[58] Field of Search ..... 427/430.1, 407.1

[56] References Cited

U.S. PATENT DOCUMENTS

| | | | |
|---|---|---|---|
| 4,265,990 | 5/1981 | Stolka et al. | 430/59 |
| 4,610,942 | 9/1986 | Yashiki et al. | 430/58 |
| 4,652,507 | 3/1987 | Dössel et al. | 430/57 |
| 5,213,937 | 5/1993 | Miyake | 430/130 |
| 5,244,697 | 9/1993 | Vackier et al. | 427/430.1 |
| 5,334,246 | 8/1994 | Pietrzykowski, Jr. et al. | 118/69 |

*Primary Examiner*—Shrive Beck
*Assistant Examiner*—David M. Maiorana
*Attorney, Agent, or Firm*—Zosan S. Soong

[57] ABSTRACT

There is disclosed a dip coating method for fabricating a photosensitive member comprising: (a) dipping a substrate into a coating solution comprised of a photosensitive material and raising the substrate, thereby depositing a coating of the photosensitive material on the substrate; and (b) dipping the substrate in the same coating solution and raising the substrate, thereby increasing the thickness of the coating.

12 Claims, No Drawings

MULTIPLE DIP COATING METHOD

This invention relates generally to a multiple dip coating method useful for example in the fabrication of a photosensitive member and more particularly to a dip coating method which involves at least two dip coating cycles to increase the thickness of a photosensitive layer, especially a charge transport layer. The combination of the dipping motion of the substrate into the coating solution and the subsequent raising motion of the substrate from the coating solution constitutes one dip coating cycle.

Dip coating is a coating method involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed. However, the coating thickness cannot increase beyond a certain point for a given coating solution even at an extremely high take-up speed. For example, it is believed that conventional dip coating methods, employing a single dip coating cycle, cannot result in a charge transport layer which has a thickness greater than about 24 microns without experiencing an unacceptable level of sloping in the thickness. A thicker photosensitive layer is advantageous especially for the charge transport layer. In electrostatographic apparatus, the top layer of the photosensitive member, which may be the charge transport layer, is subjected to wear by repeated contact with for example a cleaning blade and a bias charge roll and consequently a thicker top layer may improve the life of the photosensitive member. Thus, there is a need, which the present invention addresses, for a new dip coating method which can produce a thicker photosensitive layer such as a layer having a thickness of greater than 24 microns.

The following documents disclose conventional dip coating methods, dip coating apparatus, and photosensitive members: Miyake, U.S. Pat. No. 5,213,937; Dossel et al., U.S. Pat. No. 4,652,507; and Pietrzykowski, Jr. et al., U.S. Pat. No. 5,334,246, the disclosures of which are totally incorporated by reference.

SUMMARY OF THE INVENTION

The present invention is accomplished by providing a dip coating method for fabricating a photosensitive member comprising:

(a) dipping a substrate into a coating solution comprised of a photosensitive material and raising the substrate, thereby depositing a coating of the photosensitive material on the substrate; and (b) dipping the substrate in the same coating solution and raising the substrate, thereby increasing the thickness of the coating.

There is also provided in embodiments a dip coating method for fabricating a photosensitive member comprising:

(a) dipping a substrate into a charge generating solution comprised of a charge generating material and raising the substrate, thereby depositing a first coating of the charge generating material on the substrate;

(b) dipping the substrate, having the first coating of the charge generating material thereon, in a charge transport solution comprised of a charge transport material and raising the substrate, thereby depositing a second coating of the charge transport material on the first coating; and (c) dipping the substrate subsequent to (b) in the charge transport solution and raising the substrate, thereby increasing the thickness of the second coating of the charge transport material.

DETAILED DESCRIPTION

A chucking apparatus engages one end of a substrate and moves the substrate as follows: (a) dipping a substrate into a coating solution comprised of a photosensitive material and raising the substrate, thereby depositing a coating of the photosensitive material on the substrate; and (b) dipping the substrate in the same coating solution and raising the substrate, thereby increasing the thickness of the coating. The combination of the dipping motion and the subsequent raising motion constitutes one dip coating cycle where (a) is the first dip coating cycle and (b) is the second dip coating cycle. The present invention employs 2, 3, 4, 5, or more dip coating cycles, preferably 2 or 3 dip coating cycles, and especially 2 dip coating cycles, to deposit the same photosensitive material on the substrate. Thus, (b) is carried out a number of times such as 1, 2, 3, 4, or more. In each dip coating cycle, the substrate may be raised from the coating solution either completely or partially such as the top non-imaging portion and the middle imaging portion, but not the bottom non-imaging portion.

The dipping and raising motions of the substrate may be accomplished at any effective speeds. The dipping speed may range for example from about 200 to about 1500 mm/min and may be a constant value. The take-up speed during the raising of the substrate may range for example from about 50 to about 500 mm/min and may be a constant value.

In preferred embodiments, there may occur one or two pauses in the present dip coating method. There may be an optional first pause between the dipping motion and the raising motion in the dip coating cycle which lasts for example from about 1 to about 60 seconds. The first pause optionally may be used in every dip coating cycle. The first pause allows any disturbance in the coating solution to dissipate. There may be an optional second pause subsequent to the raising motion and prior to the dipping motion of the next dip coating cycle which lasts for example from about 60 to about 600 seconds. The second pause may be optionally used every time the substrate is raised from the coating solution. The second pause promotes evaporation of the liquid such as a solvent in the coating of the photosensitive material. Air drying devices such as air rings may be optionally employed during the second pause to accelerate the evaporation of the liquid in the coating.

When the desired thickness of the photosensitive material coating is reached, the coated substrate is subjected to elevated temperatures such as from about 100 to about 160 degrees Centigrade for about 0.2 to about 2 hours. Optionally, the coating on the substrate may be heat dried as described herein to remove substantially all of the liquid in the coating prior to the next dip coating cycle.

The present invention permits relatively thick coatings of photosensitive material such as greater than 24 microns, preferably from about 28 to about 60 microns, and more preferably from about 30 to about 50 microns (these values are dry coating thicknesses). The photosensitive material may be a charge generating material and/or a charge transport material.

The present invention also permits a wider range of materials to be used in the coating solution including for example low viscosity materials which generally tend to result in thin coatings using a single dip coating cycle. Thus, the instant invention can create thicker coatings even using low viscosity materials by increasing the number of dip coating cycles.

The substrate preferably is a hollow cylinder and when coated with the photosensitive material the substrate may define a top non- imaging portion, a middle imaging portion, and a bottom non-imaging portion. The precise dimensions of these three substrate portions vary in embodiments. As illustrative dimensions, the top non-imaging portion ranges in length from about 10 to about 50 mm, and preferably from about 20 to about 40 mm. The middle imaging portion may range in length from about 200 to about 400 mm, and preferably from about 250 to about 300 mm. The bottom non-imaging portion may range in length from about 10 to about 50 mm, and preferably from about 20 to about 40 mm.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 ram. The substrate can be fabricated from any other conventional material, including organic and inorganic materials. Typical substrate materials include insulating non- conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

The substrate may be bare of layered material or may be coated with a layered material prior to dipping of the substrate into the coating solution containing the photosensitive material. For example, the substrate may be previously coated with one or more of the following: a different photosensitive material, a subbing layer, a barrier layer, an adhesive layer, and any other layer typically employed in a photosensitive member.

The coating solution may comprise components for the charge transport layer and/or the charge generating layer, such components and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

About 20 liters of a charge transport layer coating solution was prepared having the following composition: 10% by weight N,N'-diphenyl-N,N'-bis(3-methylphenyl)-[1,1'-biphenyl]-4,4'diamine; 14% by weight poly(4,4'-diphenyl-1,1'-cyclohexane carbonate (400 molecular weight); 57% by weight tetrahydrofuran; and 19% by weight monochlorobenzene. A hollow aluminum cylinder was selected with the following dimensions: a length of about 340 mm, an outside diameter of about 84 mm, and a wall thickness of about 1 min. The cylinder was previously dip coated with a layer of charge generating material having a wet thickness of about 1 micron. The charge generating material coating solution comprised: 2% by weight hydroxy gallium phthalocyanine; 1% by weight terpolymer of vinyl acetate, vinyl chloride, and maleic acid; and 97% by weight cyclohexanone. A chucking apparatus engaged the top end of the cylinder and dipped the cylinder vertically (bottom end first) into the charge transport coating solution except for the top 10 mm of the length of the cylinder at a dipping speed of about 600 mm/min. There was a first pause of about 10 seconds where the cylinder was motionless after it was dipped into the coating solution. The cylinder was raised completely out of the coating solution at a constant take-up speed of about 120 mm/min. After withdrawal of the cylinder from the coating solution, there was a second pause of about 600 seconds where the cylinder was motionless to promote air drying of the coating to a tacky film. The cylinder was dipped again into the coating solution except for the top 10 mm of the length of the cylinder at a dipping speed of about 600 mm/min. There was a first pause of about 10 seconds where the cylinder was motionless after it was dipped into the coating solution. The cylinder was raised completely out of the coating solution at a constant take-up speed of about 120 mm/min. After withdrawal of the cylinder from the coating solution, there was a second pause of about 180 seconds where the cylinder was motionless to promote air drying of the coating to a tacky film. The cylinder was conveyed to a drying oven where the cylinder was subjected to a temperature of about 118 degrees Centigrade for about 55 minutes. The coating of the charge transport material had a substantially uniform, dry thickness of about 42 microns (thickness varies from this value by plus or minus 2.5 microns) in the imaging portion.

COMPARATIVE EXAMPLE

A second hollow aluminum cylinder, identical to the cylinder in Example 1, was dip coated according to the same procedure described in Example 1 except that there was only a single dip coating cycle. The steps of this comparative example involved the following: a dipping motion, a first pause, and a raising motion, a second pause, and the oven drying step. The coating of the charge transport material had a substantially uniform, dry thickness of about 23 microns (thickness varies from this value by plus or minus 1 micron) in the imaging portion.

As seen above, the present invention significantly increases the thickness of the photosensitive material coating as compared with a single dip coating procedure, thereby improving the life of the resulting photosensitive member.

Other modifications of the present invention may occur to those skilled in the art based upon a reading of the present disclosure and these modifications are intended to be included within the scope of the present invention.

We claim:

1. A dip coating method for fabricating a photosensitive member comprising:

(a) dipping a substrate into a coating solution comprised of a photosensitive material and raising the substrate, thereby depositing a coating of the photosensitive material on the substrate; and (b) dipping the substrate in the same coating solution and raising the substrate, thereby increasing the thickness of the coating.

2. The method of claim 1, further comprising pausing between (a) and (b) for a period of time to promote evaporation of the liquid in the coating.

3. The method of claim 2, wherein there is a pause of from about 60 to about 600 seconds.

4. The method of claim 1, wherein the photosensitive material is a charge generating material.

5. The method of claim 1, wherein the photosensitive material is a charge transport material.

6. The method of claim 1, further comprising repeating (b).

7. The method of claim 1, wherein (a) and (b) are accomplished by raising the substrate at a constant take-up speed.

8. The method of claim 1, further comprising prior to (a) dipping the substrate into a different coating solution comprised of a different photosensitive material and raising the substrate, thereby depositing a layer of the different photosensitive material on the substrate.

9. The method of claim 1, wherein (a) comprises dipping the substrate devoid of layered material into the coating solution.

10. The method of claim 1, wherein (a) comprises dipping the substrate previously coated with a layered material into the coating solution.

11. A dip coating method for fabricating a photosensitive member comprising:

(a) dipping a substrate into a charge generating solution comprised of a charge generating material and raising the substrate, thereby depositing a first coating of the charge generating material on the substrate;

(b) dipping the substrate, having the first coating of the charge generating material thereon, in a charge transport solution comprised of a charge transport material and raising the substrate, thereby depositing a second coating of the charge transport material on the first coating; and (c) dipping the substrate subsequent to (b) in the charge transport solution and raising the substrate, thereby increasing the thickness of the second coating of the charge transport material.

12. The method of claim 11, further comprising pausing between (b) and (c) for a period of time to promote evaporation of the liquid in the coating.

* * * * *